US011060354B2

(12) United States Patent
Reid et al.

(10) Patent No.: US 11,060,354 B2
(45) Date of Patent: Jul. 13, 2021

(54) HINGED STEP FOR SMALL PERSON

(71) Applicant: DEVELOPPEMENTS LAFOND ET REID INC., Blainville (CA)

(72) Inventors: Frederick Reid, Montreal (CA); Jean-Francois Lafond, Blainville (CA); Behrang Mazaheri-Tehrani, Montreal (CA)

(73) Assignee: DEVELOPPEMENTS LAFOND ET REID INC., Blainville (CA)

( * ) Notice: Subject to any disclaimer, the term of this patent is extended or adjusted under 35 U.S.C. 154(b) by 280 days.

(21) Appl. No.: 16/071,820

(22) PCT Filed: Jan. 20, 2017

(86) PCT No.: PCT/CA2017/000014
§ 371 (c)(1),
(2) Date: Jul. 20, 2018

(87) PCT Pub. No.: WO2017/124180
PCT Pub. Date: Jul. 27, 2017

(65) Prior Publication Data

US 2019/0024455 A1 Jan. 24, 2019

Related U.S. Application Data

(60) Provisional application No. 62/286,301, filed on Jan. 22, 2016.

(51) Int. Cl.
*E06C 1/00* (2006.01)
*E06C 1/38* (2006.01)
(Continued)

(52) U.S. Cl.
CPC ..... *E06C 1/005* (2013.01); *A47K 17/00* (2013.01); *A47K 17/02* (2013.01); *E06C 1/381* (2013.01)

(58) Field of Classification Search
CPC ..... E06C 1/005; E06C 1/381; A47K 17/00; A47K 17/02; A61G 7/0755;
(Continued)

(56) References Cited

U.S. PATENT DOCUMENTS 1,239,185 A * 9/1917 Hunt ..... B60N 2/3065 297/334
2,158,949 A 5/1939 Sarles et al.
(Continued)

FOREIGN PATENT DOCUMENTS

| | | |
|---|---|---|
| DE | 3439391 | 4/1986 |
| JP | H07265231 | 10/1995 |
| WO | 2010121622 | 10/2010 |

OTHER PUBLICATIONS

Lord, Christine, PCT International Search Report (ISR) of PCT/CA2017/000014 (Form PCT/ISA/210), dated Apr. 11, 2017, 5 pages.

*Primary Examiner* — Alvin C Chin-Shue
*Assistant Examiner* — Shiref M Mekhaeil
(74) *Attorney, Agent, or Firm* — Benoit & Cote Inc.; Charles-André Caron

(57) ABSTRACT

There is described a step comprising a single foot secured to the floor for supporting a hinge system and a board onto which a user can step. The foot has an inclination Θ with respect to the floor, wherein the inclination Θ is fixed and lies between 45° and 80°. The hinge system installed on the foot provides a hinge with respect to the foot. The board extending in a plane is fixedly secured to the hinge system and hinges between a stowed position and a working position. The board is substantially horizontal when in the working position, and inclined at the inclination Θ when in the stowed position. The board is adjacent to surfaces of the foot and of the cap onto the hinge system, and does not
(Continued)

define any acute angle with these adjacent surfaces. The board has a recess that, upon hinging, always conforms to the cap.

16 Claims, 12 Drawing Sheets

(51) Int. Cl.
*A47K 17/00* (2006.01)
*A47K 17/02* (2006.01)

(58) Field of Classification Search
CPC .. A47B 2200/0098; B60N 3/06; B60N 3/063; B64D 11/0639; A47C 9/005; A47C 9/025; A47C 9/027; A47C 7/503; A47C 7/506; A47C 7/563; A47C 7/566; A47C 16/04; A47C 16/025; A47C 16/02; A47C 1/04; A47C 1/08; A47C 1/121; A47C 1/122
USPC ..... 297/14, 332, 333, 331, 423.12, 423.14, 297/423.15, 423.46
See application file for complete search history.

(56) References Cited

U.S. PATENT DOCUMENTS 2,268,914 A * 1/1942 Vandervoort ..... A47C 7/58 297/332
2,315,801 A * 4/1943 Lave ..... B61D 17/10 16/267
2,570,865 A 10/1951 Sabo
2,599,529 A 6/1952 Harvey
2,746,664 A 5/1956 Strmic
2,873,056 A 7/1957 Gratton
2,858,056 A 10/1958 Ownby
3,625,563 A * 12/1971 Dickinson ..... A47C 3/20 297/333
3,986,503 A * 10/1976 Le Guillon ..... B60R 3/02 182/89
4,135,604 A 1/1979 Ryan
4,404,695 A * 9/1983 Camp ..... A47K 13/26 292/4
4,460,215 A * 7/1984 Chamberlain ..... A47C 9/06 297/14
4,462,486 A * 7/1984 Dignan ..... B60R 3/02 182/91
4,884,842 A * 12/1989 Finkelstein ..... A47C 9/06 297/331
4,930,839 A * 6/1990 Saito ..... A45B 5/00 248/155.3
5,185,892 A * 2/1993 Mitchell ..... A47K 3/122 297/14
5,358,067 A 10/1994 Ford et al.
5,647,072 A * 7/1997 Shaffer ..... A47K 3/281 4/574.1
5,720,522 A * 2/1998 Habeck ..... A47C 9/06 108/27
5,765,921 A * 6/1998 Chuang ..... A47C 16/025 297/423.41
6,065,251 A * 5/2000 Kindrick ..... A47K 3/001 108/157.13
6,471,002 B1 * 10/2002 Weinerman ..... B60R 3/02 182/90
6,527,341 B1 * 3/2003 Martin ..... A47C 1/12 248/240.4
6,807,690 B1 * 10/2004 Satterfield ..... A47K 3/282 297/14
7,000,989 B2 * 2/2006 Fisher ..... A47C 1/121 297/335
7,303,235 B1 * 12/2007 Fongers ..... A47C 1/121 297/217.7
7,716,757 B2 * 5/2010 Sumpton ..... A47K 17/028 182/35
7,976,042 B2 * 7/2011 Watson ..... B60R 3/02 280/166
8,037,557 B2 * 10/2011 Sumpton ..... A47K 17/028 182/35
8,702,046 B2 * 4/2014 Cooper ..... B60R 11/02 108/141
8,925,682 B2 1/2015 Chitayat et al.
9,290,991 B1 3/2016 McDill
10,479,278 B2 * 11/2019 Du ..... B60R 3/02
2002/0084686 A1 * 7/2002 Takata ..... B60N 2/856 297/408
2003/0189368 A1 * 10/2003 Fewchuk ..... A47B 3/08 297/332
2008/0264723 A1 10/2008 Tatum et al.
2009/0188754 A1 7/2009 Warren et al.
2011/0024246 A1 * 2/2011 Mitjans ..... A47C 7/566 188/297
2011/0298252 A1 * 12/2011 King ..... A47C 1/121 297/188.14
2013/0186709 A1 7/2013 White
2015/0001005 A1 1/2015 Goodson
2015/0090528 A1 4/2015 Binegar
2019/0161194 A1 * 5/2019 Pacheco ..... B64D 11/0691

* cited by examiner

HINGED STEP FOR SMALL PERSON

CROSS-REFERENCE TO RELATED APPLICATIONS

This application claims benefit or priority from provisional U.S. patent application 62/286,301, filed Jan. 22, 2016, the specification of which is hereby incorporated herein by reference in its entirety.

BACKGROUND

(a) Field

The subject matter disclosed generally relates to steps. More specifically, it relates to a step for a small person to access a sink.

(b) Related Prior Art

Steps are used in a variety of contexts. An exemplary situation in which steps are desirable is a public restroom, where children or otherwise small people can find difficult to access the sink to wash their hands because the sink is too high for them.

Steps or stools have been designed for such cases, as shown in U.S. Pat. Nos. 2,570,865, 2,858,056, and 4,135,604 and in patent publications US20130186709 and DE3439391. These steps all need to be secured to a wall, an inner surface of a cabinet or the plumbing under the sink. In public restrooms, any one of these structures may not be suitably located to perform this kind of attachment in all cases, e.g., the front of the sink can be located away from a wall, usually does not have a cabinet, and can have its plumbing concealed. Also, attaching a stool to the plumbing can apply undue pressure on the piping which can cause damages to the plumbing.

U.S. Pat. No. 8,037,557 issued to Sumpton describes a step secured only to the floor.

SUMMARY

According to a first aspect, there is provided a step comprising: a single foot secured to a floor and having an inclination θ with respect to the floor, wherein the inclination θ is fixed and lies between 45° and 80°; a hinge system installed on the foot and providing a hinge with respect to the foot; a board onto which a user can step, the board extending in a plane and being fixedly secured to the hinge system for providing a hinging movement about a hinge axis between a stowed position and a working position; wherein the plane of the board is substantially horizontal when the board is in the working position, and the plane of the board is substantially inclined at the inclination θ when the board is in the stowed position.

According to an embodiment, the hinge system comprises a static portion fixed with respect to the foot and a rotative portion hingeable, about the hinge axis, with respect to the static portion.

According to an embodiment, the hinge system comprises a shaft fixedly secured to the board for confining any movement of the board to the hinging movement.

According to an embodiment, the static portion comprises static knuckles holding the shaft therein and by which the shaft can rotate.

According to an embodiment, the rotative portion comprises a first stopper and a second stopper which abut on a first abutting surface of the static portion when the board is in the stowed position and on a second abutting surface of the static portion when the board is in the working position, respectively.

According to an embodiment, at least one of the first stopper and the second stopper is made of an elastic material to dampen the hinging movement when a respective one of the stowed position and the working position is reached.

According to an embodiment, the static portion further comprises a hinge fixture secured to the foot and comprising the first abutting surface and the second abutting surface.

According to an embodiment, there is further provided a spring within the foot, secured to the foot and linked to the hinge system, urging the board toward the stowed position when no weight is applied on the board.

According to an embodiment, there is further provided a string secured to the spring and to the rotative portion for pulling the rotative portion and the first stopper toward the first abutting surface.

According to an embodiment, there is further provided a cap over the foot and covering the hinge system, wherein the board has a recess about its periphery and around the hinge system, the recess having a shape; and the cap has an outer surface substantially defined as a result of the shape of the recess partially revolving about the hinge axis.

According to an embodiment, the recess of the board has a shape of an arc of circle and the cap has a surface of a sphere wedge.

According to an embodiment, the recess of the board has a substantially semicircular shape and the cap has a hemispherical surface.

According to an embodiment, the recess of the board has a substantially rectangular shape and the cap has surface of a cylinder wedge.

According to a second aspect, there is provided a step comprising: a foot; a hinge system installed on the foot and providing a hinge with respect to the foot; a board onto which a user can step, the board being fixedly secured to the hinge system for providing a hingeable movement about a hinge axis between a stowed position and a working position; a cap over the foot and covering the hinge system, wherein the board is adjacent to surfaces of the foot and of the cap, wherein the board, whether in the stowed position, the working position or in-between, does not define any acute angle with the adjacent surfaces.

According to an embodiment, there is further provided a spring within the foot, secured to the foot and linked to the hinge system, urging the board toward the stowed position when no weight is applied on the board.

According to an embodiment, there is further provided a string secured to the spring and to the rotative portion for pulling the rotative portion and the first stopper toward the first abutting surface.

According to an embodiment, the board has a recess about its periphery and around the hinge system, the recess having a shape; and the cap has an outer surface substantially defined as a result of the shape of the recess partially revolving about the hinge axis.

According to an embodiment, the recess of the board has a shape of an arc of circle and the cap has a surface of a sphere wedge.

According to an embodiment, the recess of the board has a substantially semicircular shape and the cap has a hemispherical surface.

According to an embodiment, the recess of the board has a substantially rectangular shape and the cap has surface of a cylinder wedge.

According to a third aspect, there is provided a step comprising: a hinge system installed on a foot and providing a hinge with respect to the foot; the foot for supporting the hinge system; a board onto which a user can step, the board being fixedly secured to the rotative portion of the hinge system, the board having a recess about its periphery and around the hinge system, the recess having a shape; and a cap over the foot and above the hinge system, the cap having an outer surface substantially defined as a result of the shape of the recess partially revolving about the hinge axis.

According to an embodiment, the recess of the board has a shape of an arc of circle and the cap has a surface of a sphere wedge.

According to an embodiment, the recess of the board has a substantially semicircular shape and the cap has a hemispherical surface.

According to an embodiment, the recess of the board has a substantially rectangular shape and the cap has surface of a cylinder wedge.

According to an embodiment, the board is adjacent to surfaces of the foot and of the cap, wherein the board is hingeable between a stowed position and a working position, and whether the board is in the stowed position, the working position or in-between, the board does not define any acute angle with the adjacent surfaces.

According to an embodiment, the foot is a single foot secured to a floor and having an inclination θ with respect to the floor, wherein the inclination θ is fixed and lies between 45° and 80°, wherein the board extends in a plane and wherein the plane of the board is substantially horizontal when the board is in the working position, and the plane of the board is substantially inclined at the inclination θ when the board is in the stowed position.

According to an embodiment, the hinge system comprises a static portion fixed with respect to the foot and a rotative portion hingeable, about a hinge axis, with respect to the static portion.

According to an embodiment, the hinge system comprises a shaft fixedly secured to the board for confining any movement of the board to a hinging movement about the hinge axis.

According to an embodiment, the static portion comprises static knuckles holding the shaft therein and by which the shaft can rotate.

According to an embodiment, the rotative portion comprises a first stopper and a second stopper which abut on a first abutting surface of the static portion when the board is in the stowed position and on a second abutting surface of the static portion when the board is in the working position, respectively.

According to an embodiment, at least one of the first stopper and the second stopper is made of an elastic material to dampen the hinging movement when a respective one of the stowed position and the working position is reached.

According to an embodiment, the static portion further comprises a hinge fixture secured to the foot and comprising the first abutting surface and the second abutting surface.

According to an embodiment, there is further provided a spring within the foot, secured to the foot and linked to the hinge system, urging the board toward the stowed position when no weight is applied on the board.

According to an embodiment, there is further provided a string secured to the spring and to the rotative portion for pulling the rotative portion and the first stopper toward the first abutting surface.

As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Each step or stool mentioned above shares the same defect: the movement of some portions of the step or stool being deployed or stowed implies either the creation and eventually closure of spacing or a gap, either the creation of acute angles, into which, in both cases, a user may pinch their fingers. If the step is to be used in an environment with small children, which is highly plausible given the nature of the apparatus, this creation of acute angles between surfaces and edges and the closure of gaps cause safety issues that need to be addressed.

There is described below a step where the moving parts do not create acute angles or close gaps, thereby mitigating the risk of pinching fingers and improving the safety of the apparatus.

In addition to the defect of prior art steps by which users can pinch their fingers, the step described in U.S. Pat. No. 8,037,557, mentioned above, has some additional flaws that are herein identified and that need to be addressed. Since the step described in U.S. Pat. No. 8,037,557 is secured only to the floor, it is natural to provide the step with at least two feet. However, having two feet implies that for each step installed in the public restroom, the maintenance person mopping the floor needs to mop around two feet and must mop in the less accessible floor surface between the feet. Since the step itself must be cleaned, the two feet must be cleaned individually and the existence of two feet on both sides of the step implies that they define inner surfaces, semiconfined under the board of the step and between each foot, that are more strenuously accessed and therefore much harder to clean well and efficiently. Therefore, total time and effort needed for maintenance is substantially increased when a single step is being installed in the public restroom. The two-foot and therefore bulky step as shown in U.S. Pat. No. 8,037,557 is also less suited to renovated public restrooms where a sleek style is usually wanted.

A one-foot embodiment of a step is herein contemplated. Although having only one foot is counter-intuitive when considering the structure and mechanics of the self-standing apparatus, the flaws identified with two-foot prior art steps have been determined as significant enough to justify developing a mechanism allowing a one-foot step, which overcomes the defects mentioned above and therefore brings several advantages in terms of maintenance and pleasant inclusion into the restroom environment. There is described below this mechanism allowing a one-foot step that also prevents pinching by avoiding or concealing any device or situation by which fingers could be pinched.

Figure 6:
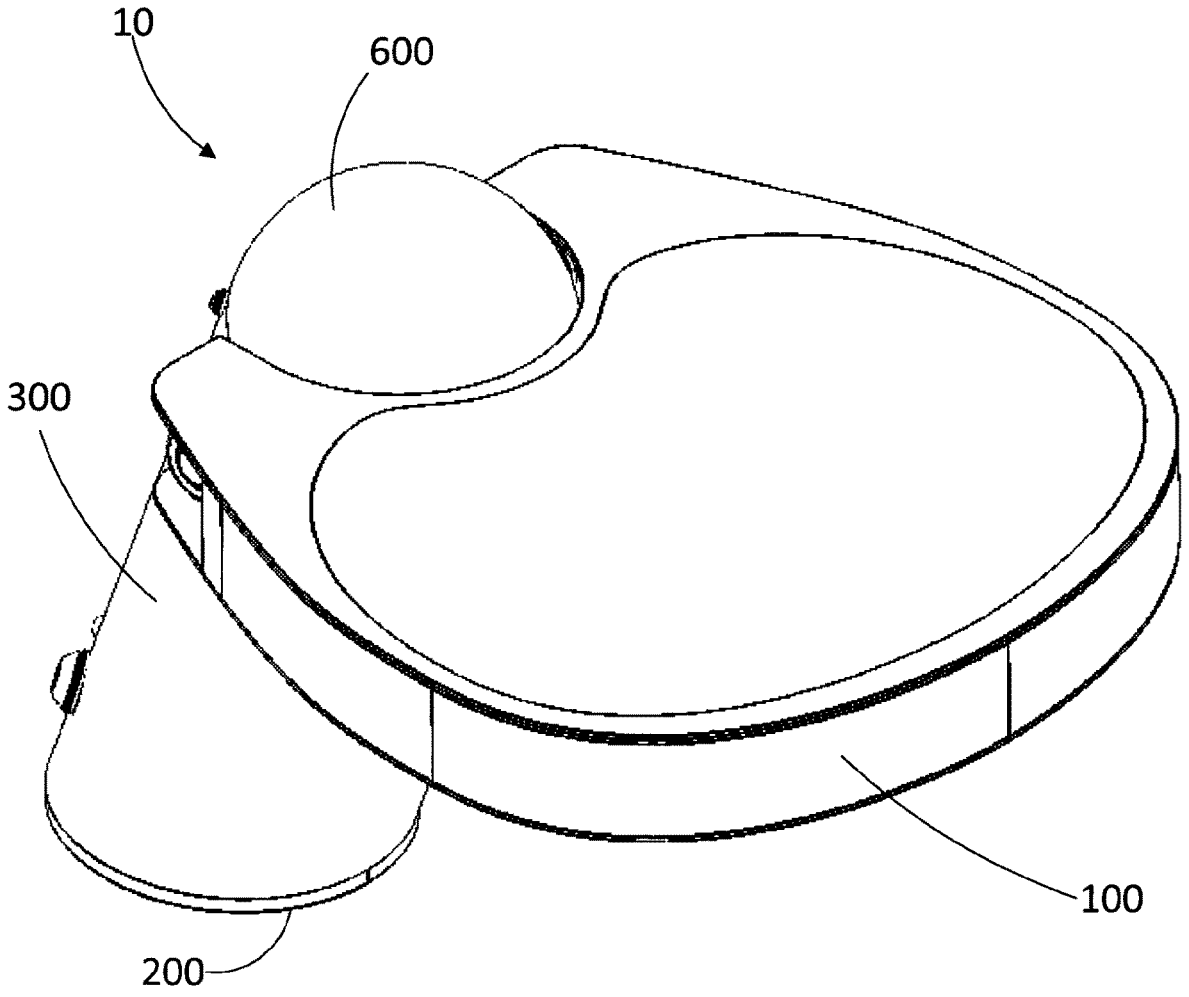
FIG. 6 is a front perspective view illustrating a step in working position, according to an embodiment.
Figure 12A:
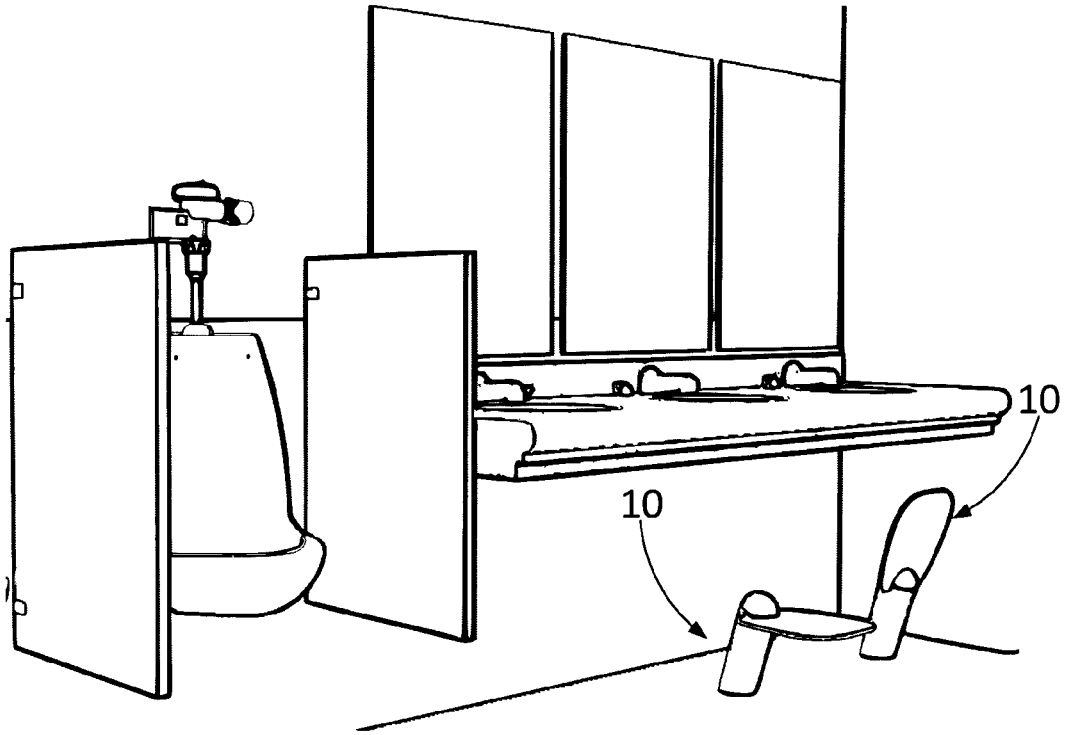
FIGS. 12A-12B are a perspective view and a side view illustrating two steps in a stowed position and in a deployed position in an exemplary context, according to an embodiment.
Figure 12B:
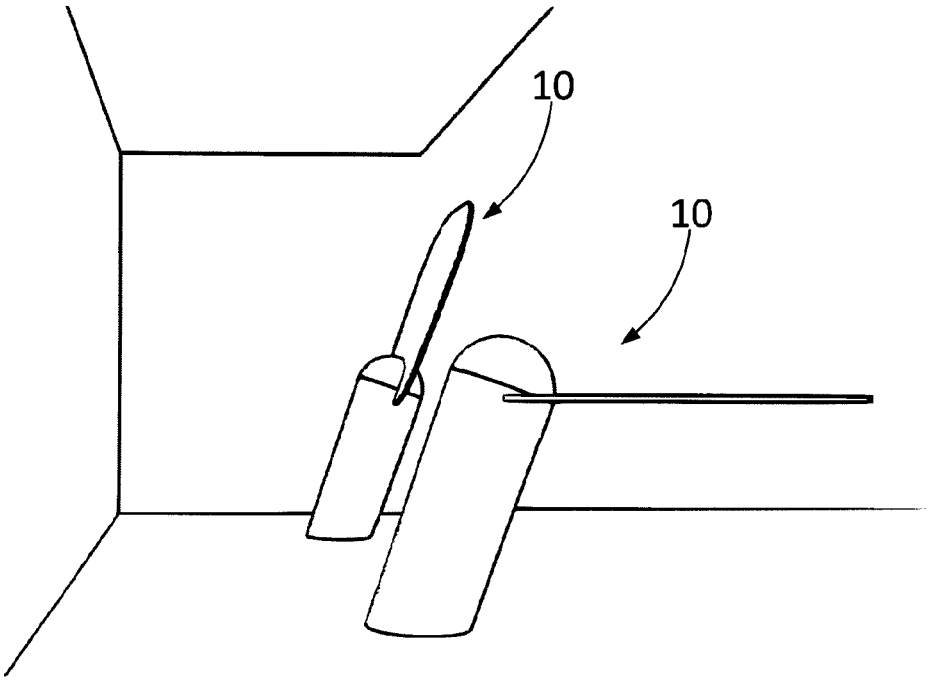

The apparatus described herein is step 10 that is retractable into a stowed position (FIGS. 7, 10) and deployed into a working position (FIGS. 6, 8-9), as shown in contextual FIGS. 12A-12B. The step 10 is hinged to allow the change of positions.

The step 10 herein described comprises only one support foot, which is convenient for maintenance purposes since the step 10 is often installed in a public restroom where maintenance needs to be performed fast and very frequently, as shown in FIGS. 12A-12B. The presence of only one foot with a smooth surface facilitates and accelerates floor maintenance in comparison with other steps having more than one foot or having complicated surfaces where dirt or bacteria can accumulate.

Moreover, advantageously, the step 10 herein described does not create any acute angle and does not close gaps during the rotation movement from the stowed position to the working position. The term "acute" is intended to mean angles for which the absolute value of the smallest angle is between 0° and 90°, the angle of 90° being excluded. This range should take into account the fact that materials could be otherwise shaped or deformed, therefore, the step 10 herein described, during the rotation movement from the stowed position to the working position, does not create any angle between 0° and 89°, or between 0° and 80°, or between 0° and 70°, or between 0° and 60°, or between 0° and 50°, or between 0° and 40°, or between 0° and 30°, or between 0° and 20°, or between 0° and 10°, or between 10° and 89°, or between 10° and 80°, or between 10° and 70°, or between 10° and 60°, or between 10° and 50°, or between 10° and 40°, or between 10° and 30°, or between 10° and 20°, or between 20° and 89°, or between 20° and 80°, or between 20° and 70°, or between 20° and 60°, or between 20° and 50°, or between 20° and 40°, or between 20° and 30°, or between 30° and 89°, or between 30° and 80°, or between 30° and 70°, or between 30° and 60°, or between 30° and 50°, or between 30° and 40°, etc. In other words, angular ranges that could cause finger pinching should be excluded by the configuration.

The step 10 comprises a board 100 onto which the user is expected to step. The board is a substantially planar surface extending along a plane and which is sufficiently large and long to receive the feet of a person stepping onto the step 10. The board 100 is the hingeable portion of the step 10.

According to an embodiment, the board 100 comprises an antiskid surface 180 to make the board less slippery for the person stepping thereonto.

The step 10 further comprises a floor fixture 200. The floor fixture 200 is the portion of the step 10 which makes up the foot base for the step 10 and which is firmly secured to the floor to prevent the step 10 from moving with respect to the floor (with the exception of the hinged movement).

According to an embodiment, the floor fixture 200 is secured to the floor using hardware, e.g., the floor fixture 200 can be screwed to the floor, or bolted, nailed, clasped, soldered, etc., or any combination of these securing means.

According to an embodiment, the floor fixture 200 is secured to the floor using an adhesive, such as glue, epoxy, cement or the like. The adhesive can also be used in combination with the hardware listed above.

The type of fixation should be sufficient to support the force and moment of force exerted on the floor fixture 200 when a user steps onto the step 10 to keep the whole foot well anchored to the floor.

Figure 1:
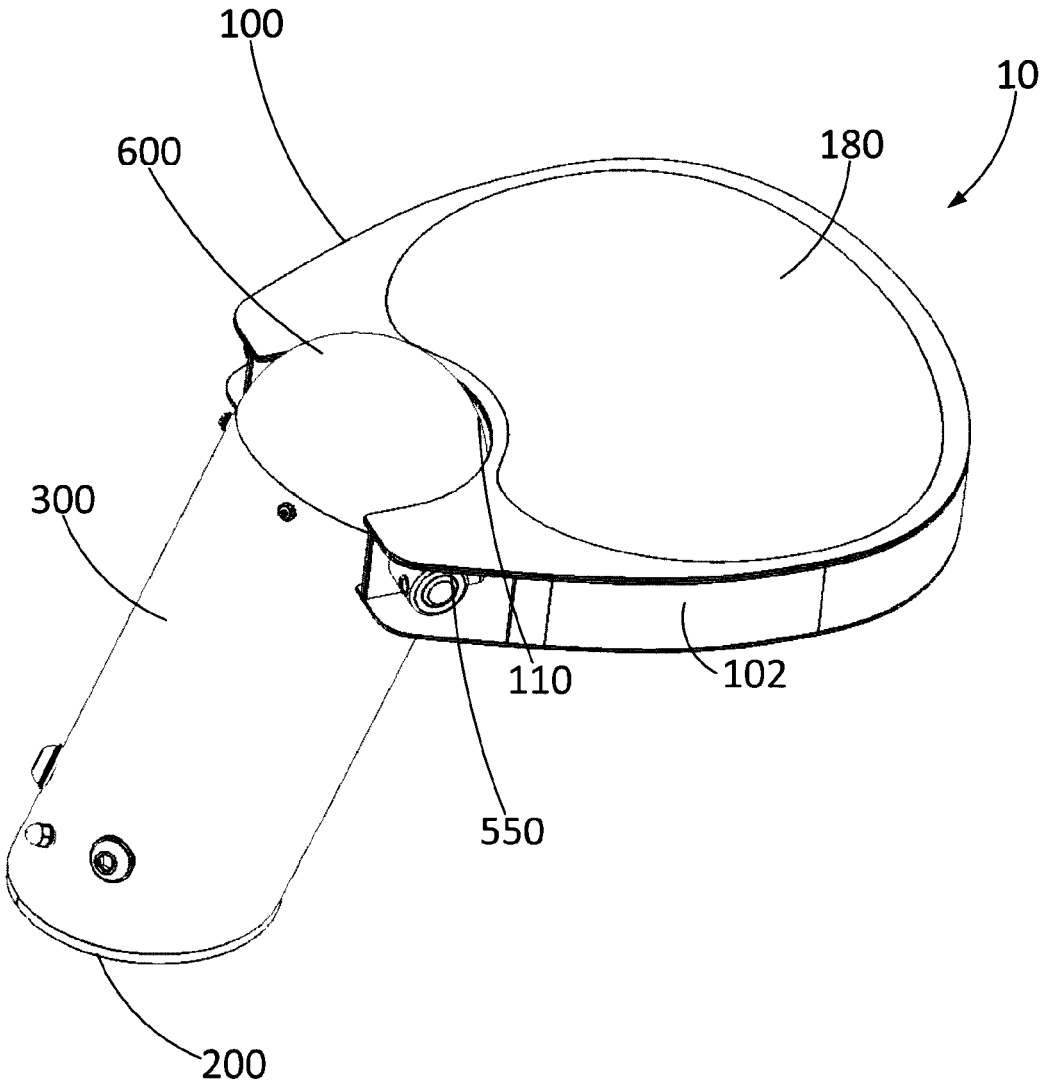
FIG. 1 is a rear perspective view illustrating a step in working position, according to an embodiment.
Figure 2:
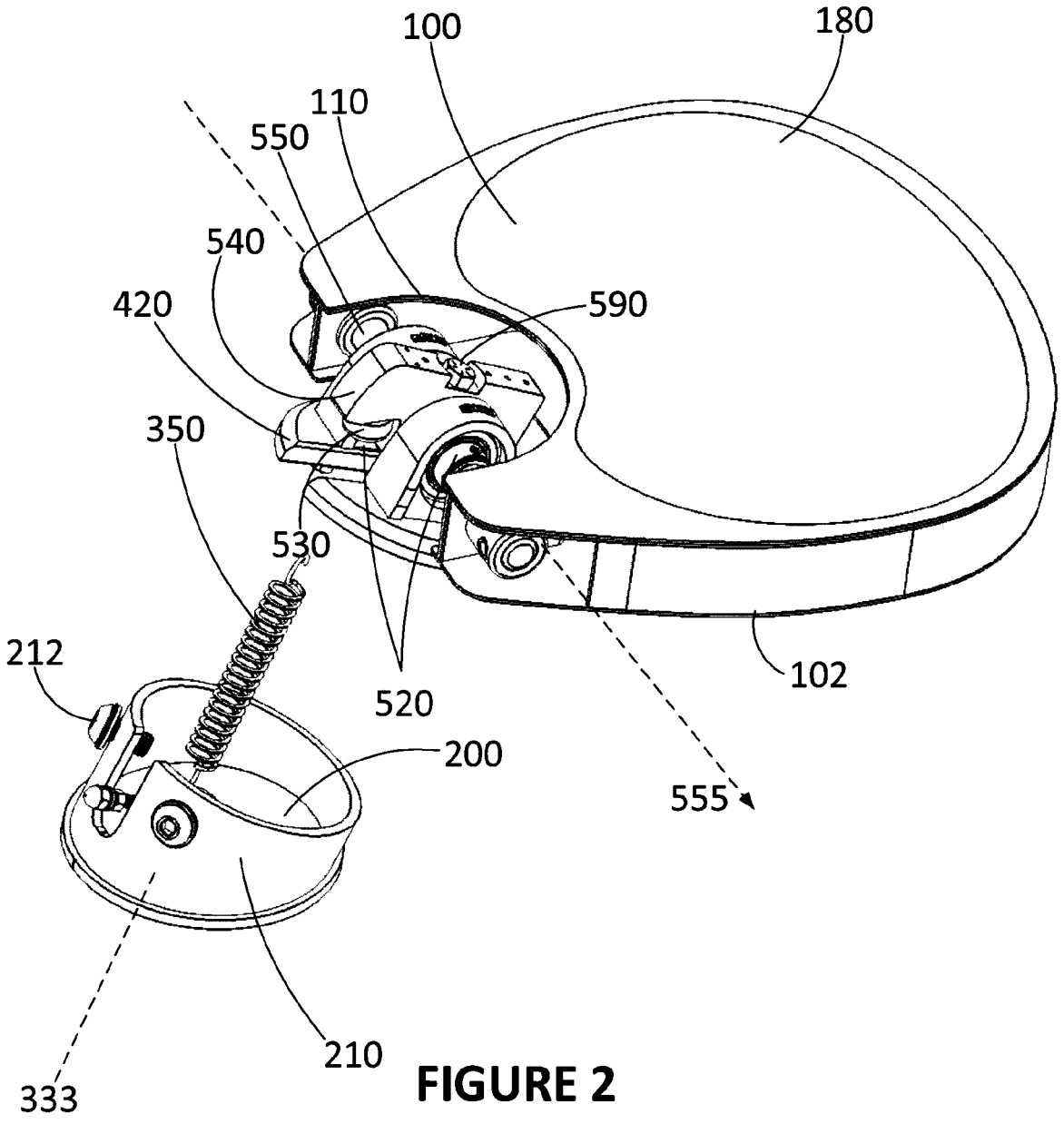
FIG. 2 is a rear perspective view illustrating the inside parts of a step in working position, according to an embodiment.

The step 10 comprises a foot support 300, making up the body of the foot, which rests on the floor fixture 200 (i.e., the foot is made of the floor fixture 200 and the support 300). The support 300 can have the shape of a cylinder, as shown in FIG. 1, and is preferably hollow if devices are to be installed therein. The cylinder shape provides a smooth and regular surface that can be easily cleaned and allow easy and fast floor maintenance around the support 300. According to an embodiment, and as shown by comparing FIGS. 1 and 2, the floor fixture 200 can comprise a base wall 210 having the same shape as the support 300 but with a smaller diameter, thereby allowing the support 300 to be fitted over the base wall 210 and held in place with the desired inclination θ with respect to the floor. According to an embodiment, securing means 212, such as screws (as shown in FIG. 2), nails, bolts, clamps and/or adhesives can be provided to fix the support 300 to the base wall 210. Different embodiments can also be contemplated for securing the support 300 to the floor fixture 200; for example, the floor fixture could comprise a socket into which the support could be inserted.

Figure 7:
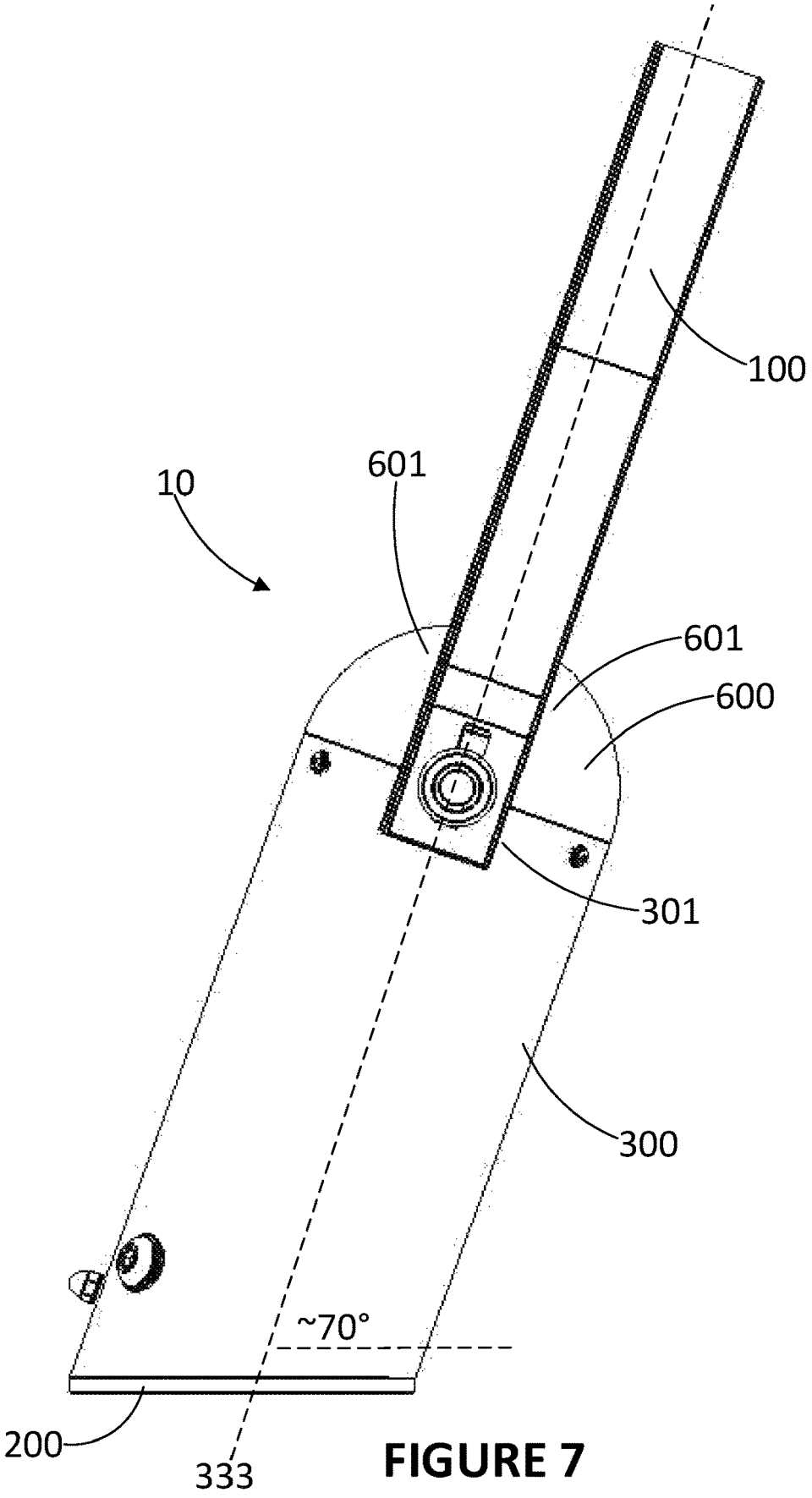
FIG. 7 is a side view illustrating a step in stowed position, according to an embodiment.
Figure 8:
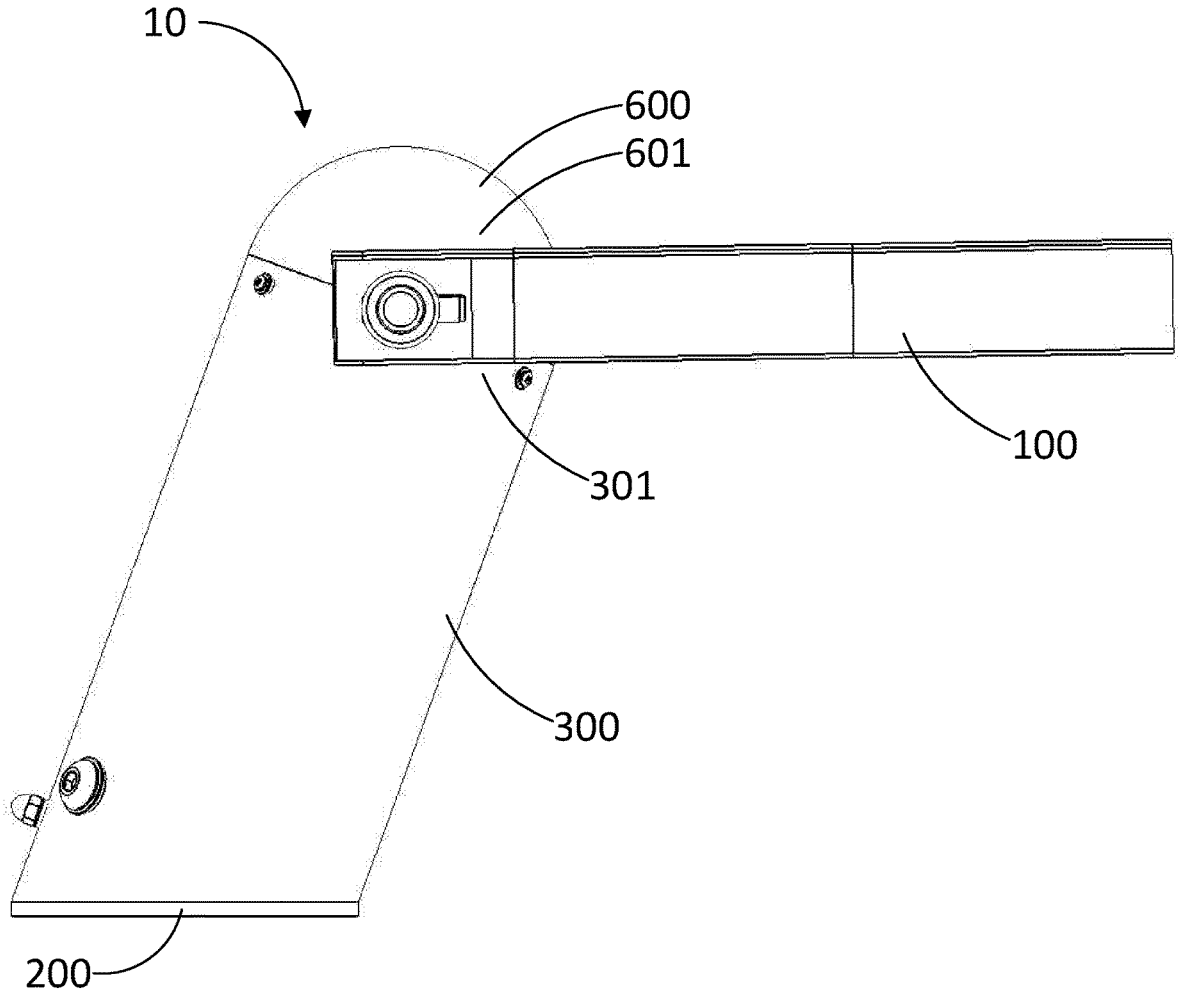
FIG. 8 is a side view illustrating a step in working position, according to an embodiment.

The support 300 is the portion of the step 10 that supports the board 100 (more specifically by supporting the hinge fixture 420) and that transmits the weight applied by the user from the board 100 down to the floor fixture 200. The support 300 extends along an axis. An axis extending along a general direction of the support 300 and centrally located within the support 300 can be defined as the central axis 333, as shown in FIGS. 2, 3, 5 and 7. The central axis 333 does not need to be vertical only. It can extend diagonally with respect to the floor. However, it needs to have a vertical component and usually, the vertical component is greater than the horizontal component such that the inclination θ of the central axis 333 with respect to the floor is usually greater than 45°. The inclination θ should be between 45° and 90°, preferably between 50° and 85°, more preferably between 60° and 80°, still more preferably about 70° as shown in FIG. 7.

The inclination of the support 300, and therefore of the foot, should be adapted to allow a non-stepping user (someone close to the step but not using it) to put the tip of their feet close to the bottom base of the support 300 while avoiding the support and the board, when in stowed position, to touch their leg, knee, lap or any other body part about as high as the top of the step in stowed position.

Preferably, both the foot inclination and the board should have the same inclination θ (i.e., they are aligned) when the step 10 is in its stowed position. This inclination should be away from vertical (i.e., θ<90°) to ensure that the board is long enough to be useful for stepping thereonto while not being in conflict with the bottom surface under the sink countertop or with the plumbing under the sink. Having the board 100 away from vertical also aids the user in gripping the board for hinging it downward into the working position. If the board 100 was vertical when stowed, it would be located directly below the sink and farther from the sink user-side edge, and the user would have to stretch the arm or leg to get to grip the board to pull it downward into the working position, which would be less comfortable and less convenient.

The hinge fixture 420 is the portion supporting the hinge static knuckle 520 and thereby supporting the hinge system 500. The hinge fixture 420 is shown as a plate that rests and is firmly secured on the top end of the support 300.

The hinge system 500 comprises hinge static knuckles 520, a hinge rotative knuckle 540 and the shaft 550, and other related devices installed on these parts, such as bearings 525. The hinge static knuckles 520 are firmly secured or integrally connected to the hinge fixture 420. The hinge static knuckles 520 comprise at least two tubular openings provided symmetrically on both sides of the central axis. The tubular openings are provided coaxially to define one axis that extends in the direction of the tubular openings and that lies in the central longitudinal axis in the center of the tubular openings, thereby defining the hinge axis 555, shown in FIGS. 2, 3 and 5. The hinge axis 555 is the axis around which the board 100 hinges when transiting from the stowed position to the working position and vice versa. A hinge rotative knuckle 540 is provided between the hinge static knuckles 520 and also comprises a tubular opening coaxially aligned (i.e., coincident) with the hinge axis 555 defined by the tubular openings of the hinge static knuckles 520 in such a way that a shaft 550 can be inserted through the aligned tubular openings of the both hinge static knuckles 520 and of the hinge rotative knuckle 540 in between.

Figure 3:
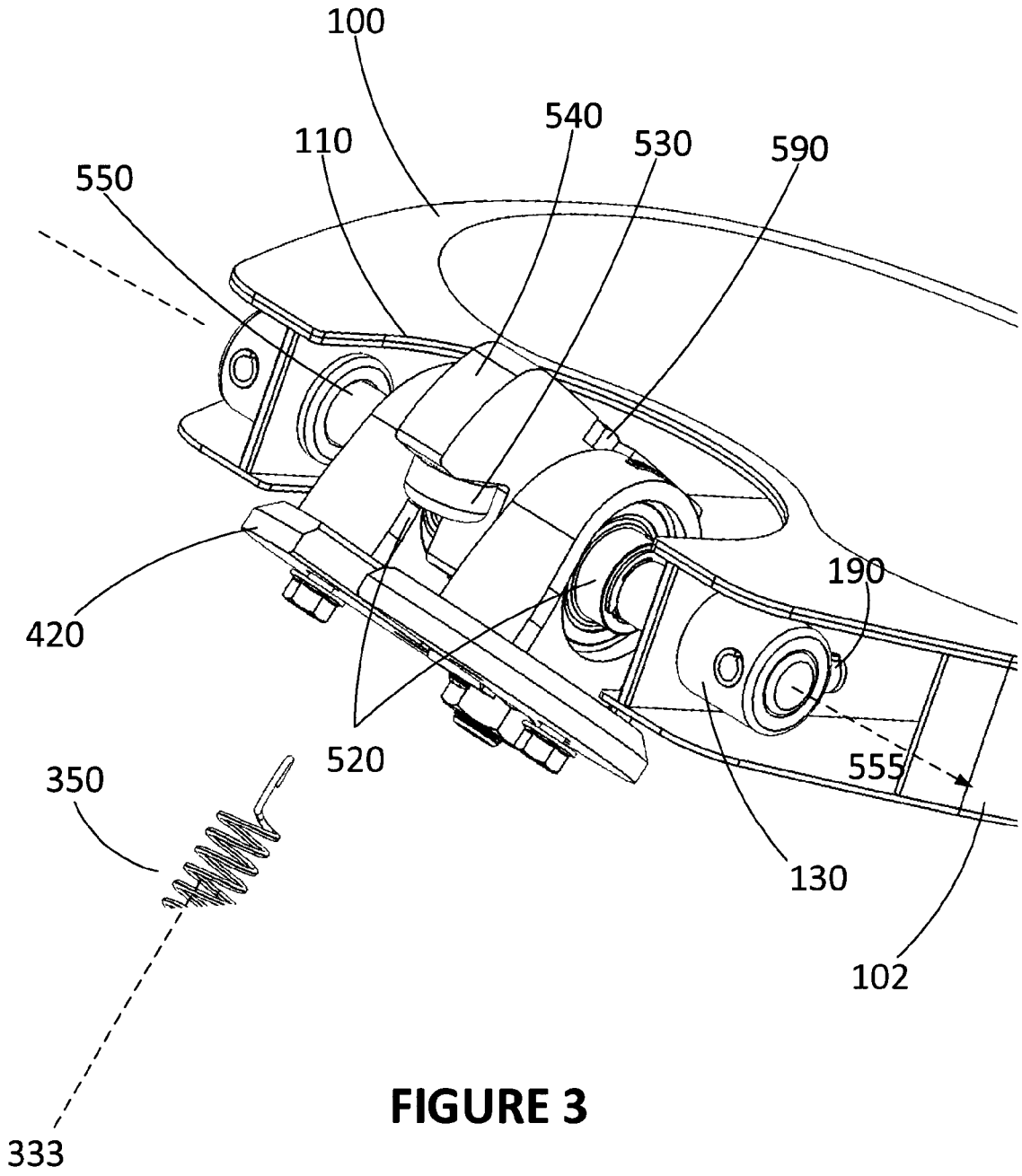
FIG. 3 is a rear perspective close-up view illustrating the inside parts of a step in working position, according to an embodiment.
Figure 9:
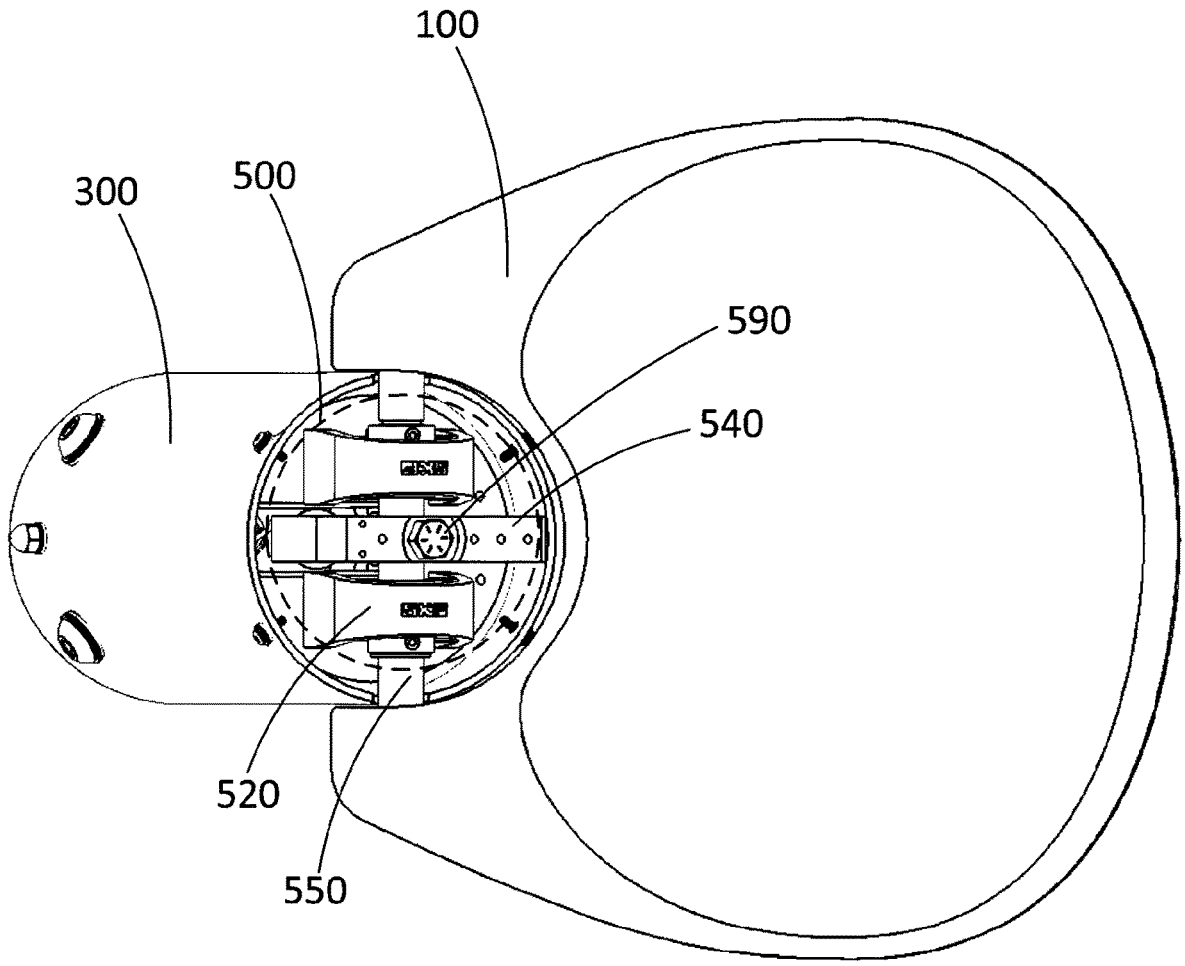
FIG. 9 is a top view illustrating a step in working position without its cap, according to an embodiment.

The hinge rotative knuckle 540 is fixed relative to the shaft 550, i.e., they are attached and thus move together. They can be integrally connected or soldered, for example. FIGS. 2, 3 and 9 show that a pin 590 is used to mechanically couple the hinge rotative knuckle 540 and the shaft 550 by extending across both to make sure they are attached and that they move together.

Figure 4:
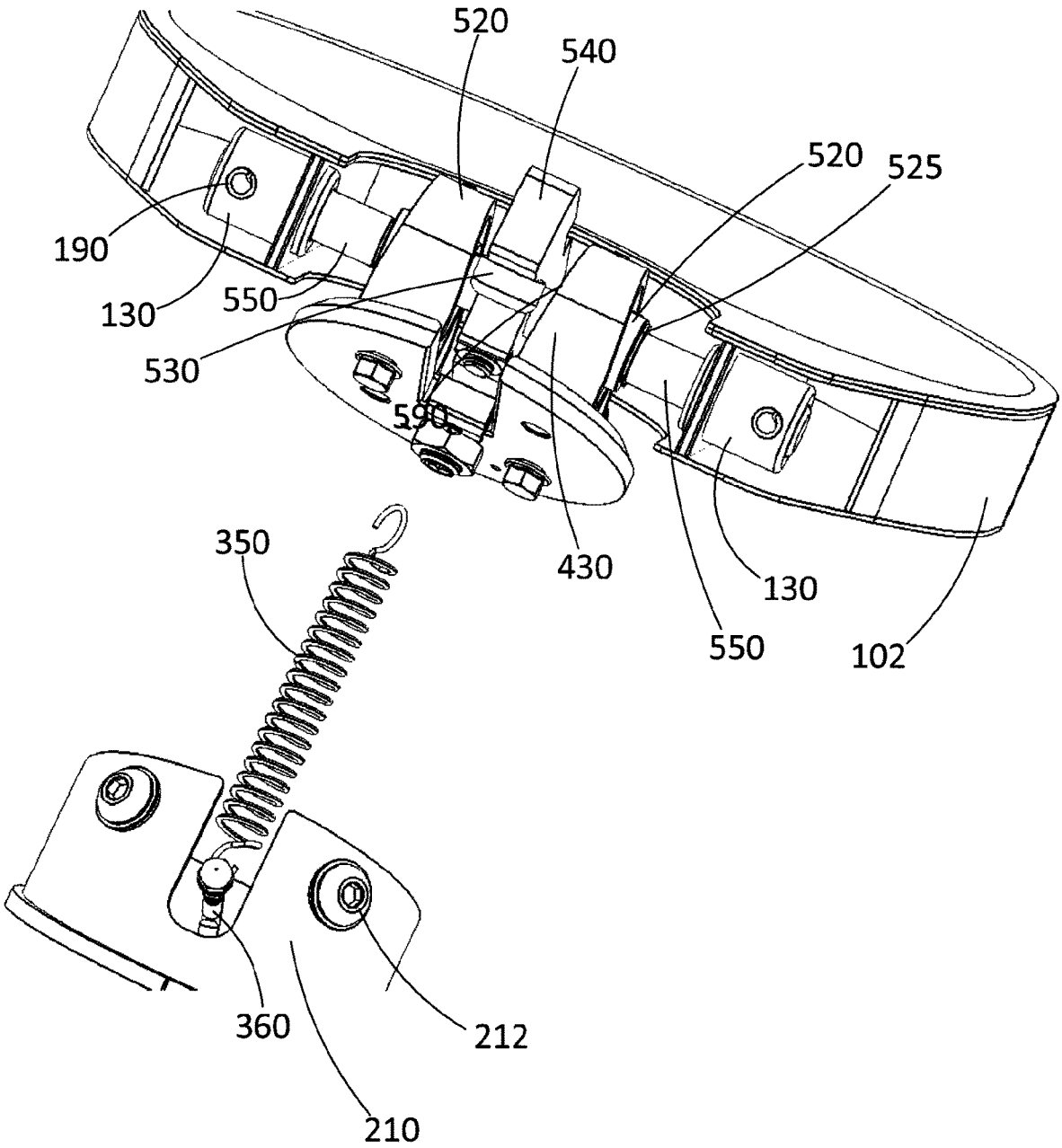
FIG. 4 is a rear close-up view illustrating the inside parts of a step in working position, according to an embodiment.

Similarly, the shaft 550 can be pinned to the board or secured by any other suitable means such as those listed above. As shown in FIGS. 3-4, sockets 130 can be provided on the board on both sides of the recess 110. The shaft 550 is therefore fitted into the sockets 130 and pins 190 are inserted through the socket 130 and shaft 550 for fixedly securing these parts together. The board thus moves along with the shaft 550 and, indirectly, with the hinge rotative knuckle 540.

Figure 10:
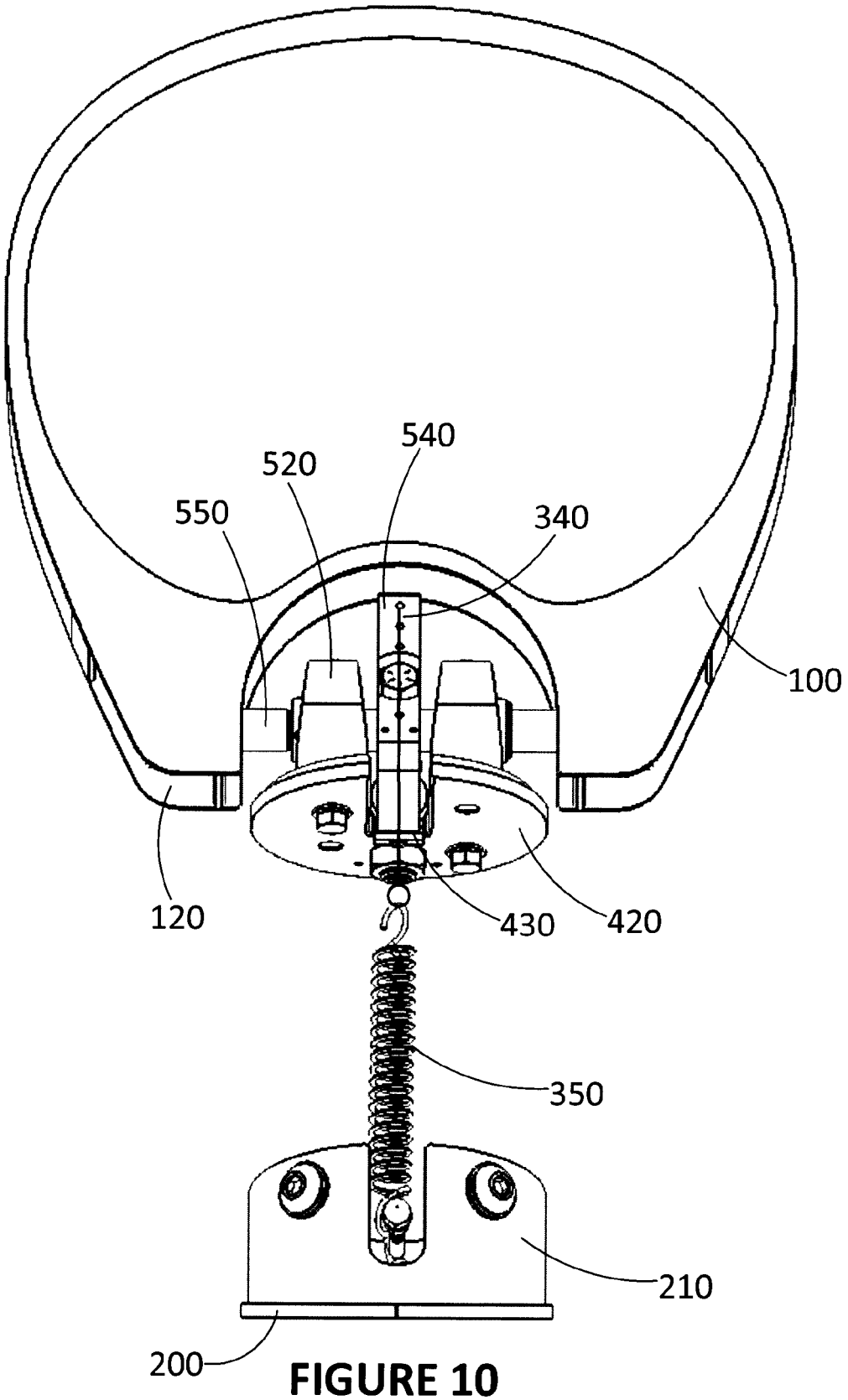
FIG. 10 is a rear view illustrating the inside parts of a step in stowed position, according to an embodiment.

The hinge rotative knuckle 540 has a stopper 530 shown in FIG. 2-4. The stopper 530 is located to abut on an abutting surface 430 provided within a recess of the hinge fixture 420. When the stopper 530 abuts on the abutting surface 430, the hinge rotative knuckle 540 and the board 100 are stopped in their rotation movement by which the board 100 goes upward; the hinging is thereby stopped and the board 100 reaches its stowed position, as shown in FIG. 10. According to an embodiment, the stopper 530 is made of a rubber or any other elastic or resilient material in order to dampen or smooth the stopping of the hinging movement when the stopper 530 hits the abutting surface 430.

Similarly, a second stopper (not shown) can be provided on another side of the hinge rotative knuckle 540. This second stopper should be located to abut on a second abutting surface, preferably to the top surface of the hinge fixture 420, in order to stop the rotation of the hinge rotative knuckle 540 and the board 100 when the working position is reached, normally when the board 100 is horizontal (i.e., parallel to the floor). Both stoppers should thus be located to allow the angular movement of the hinge rotative knuckle 540 and the board 100 from the stowed position to the working position, inclusively, but not outside these angular limits, thereby defining the suitable angular positions of the board 100 which normally ranges between the inclination θ (e.g., 70°) and the horizontal (0°).

Advantageously, a bearing 525 or more simply a bushing can be provided within each one of the tubular openings in the hinge static knuckles 520 to assist in the rotation of the shaft 550 within these tubular openings and to prevent movements other than the rotation needed for hinging. The use of knuckles for the hinge, complemented by bearings 525, ensures a smooth rotation of the board, and smoother than if other means of driving hinging movements were employed, such as the side tracks driving a pin described in U.S. Pat. No. 8,037,557.

Figure 5:
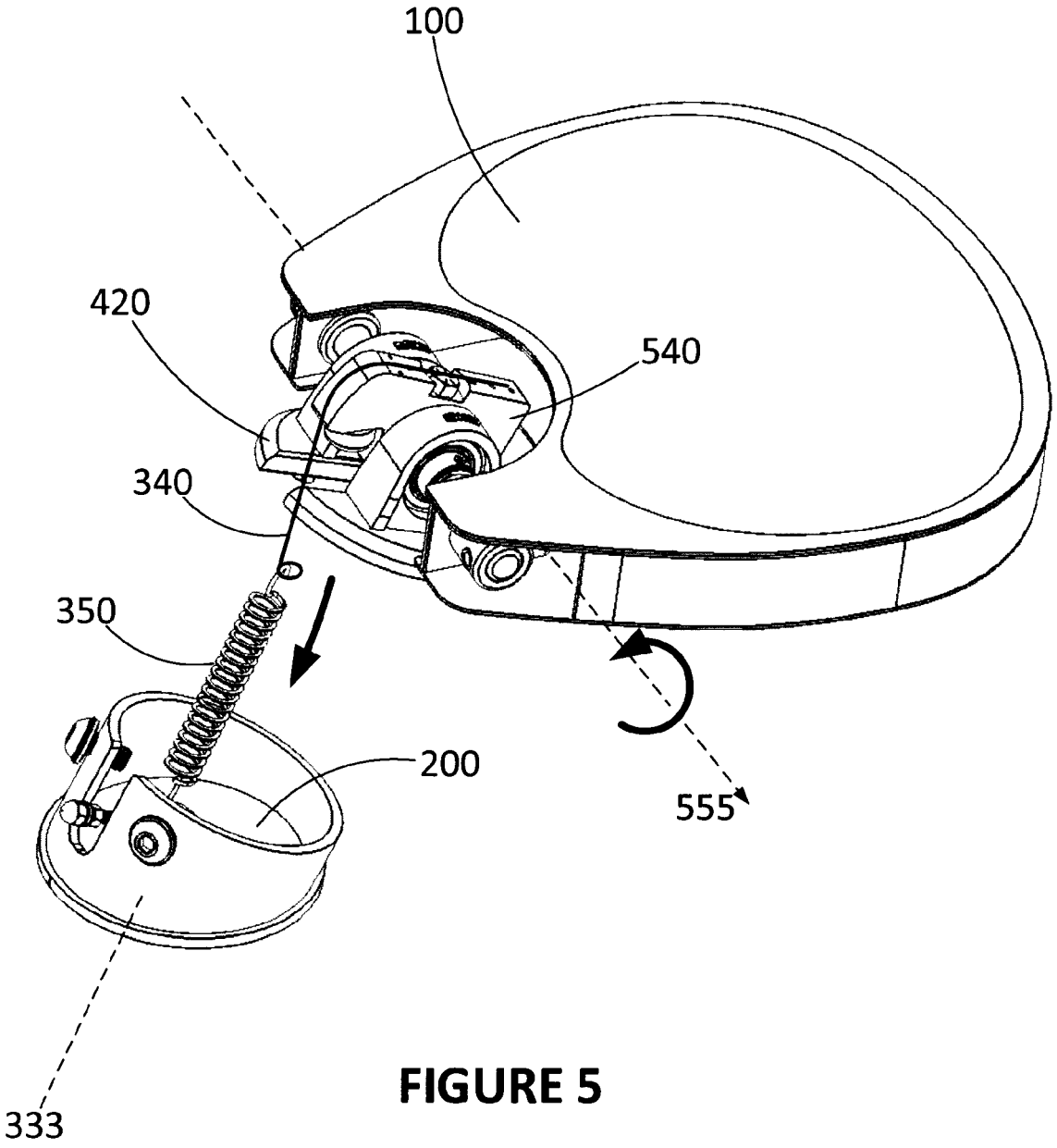
FIG. 5 is a rear perspective view illustrating the inside parts of a step in working position during a hinging movement, according to an embodiment.

According to an embodiment, as shown by FIGS. 1-2, the support 300 can house a spring 350 or any other biasing means or mechanical energy storage. As shown in FIG. 5, the spring 350 exerts a biasing force that pulls the board 100 and forces its rotation back to the stowed position when no weight is being applied onto the board 100. In practice, the spring 350 should pull on the hinge rotative knuckle 540 to actuate the hinging movement of this part, causing the rotation of the board 100.

According to an embodiment, as shown in FIGS. 5 and 10, the spring 350 is not directly attached to the hinge rotative knuckle 540, but rather, a string 340 is provided to link the spring 350 and the hinge rotative knuckle 540. This is to account for the curved side of the hinge rotative knuckle 540, to which the spring 350 would otherwise have to conform, which is difficult given the rigidity of the spring 350. Therefore, a string 340, more flexible than the spring 350, is used to be able to adapt to the shape of the back side of the hinge rotative knuckle 540 along which the string 340 extends and on which it abuts, as shown in FIGS. 5 and 10.

A cap 600, shown in FIGS. 1 and 6-8 as being hemispheric, is provided above and around the hinge system 500. The periphery of the cap 600 rests on the periphery of the top end of the support 300, and/or one the edge of the hinge fixture 420. The cap 600 covers the whole hinge system 500 such that the hinge system 500 is inaccessible to the user, hence the hemispheric shape.

The board 100 has an edge 102 comprising a recess 110 with a half-circle cross-section that conforms to the outer surface of the hemispheric cap 600, i.e., the shape defining the recess should be the same shape as the cross-section (defined as crossing the hinge axis 555) of the outer surface of the cap 600.

By aligning this semicircular recess 110 with the outer surface of the hemispheric cap 600, as shown in FIG. 1, the board can rotate around its hinge axis 555 while always having its semicircular recess 110 conform to the outer surface of the hemispheric cap 600, regardless of the angular position of the board 100 between the stowed position and working position, inclusively.

Having the edge 102 of the board 100 conform to the cap 600 on top of the support 300 for every (suitable) angular position is advantageous in that there is no space created or closed when the board 100 is being hinged. Thereby, the spacing between the edge of the recess 110 and the cap 600 is kept very slight and kept substantially constant during the hinging movement. It follows that there is no way to pinch one's fingers in the hinging step. This particularity renders the step 10 safer and more suitable for children, by whom the step 10 is likely to be used.

A close inspection of the step 10, as shown in FIG. 1 for example, shows that, in addition to the absence of variable spacing between mobile parts, there is no creation of any acute angle by the mobile parts of the step 10. In other words, when the board 100 is being hinged, at any suitable angular position, there is no acute angle formed between the board 100 and any of the adjacent structures, whether it is the support 300 or the hemispheric cap 600. The edge 102 always forms an angle of about 90° with the support 300. The top surface of the board 100 always forms an angle of about 90° with the hemispheric cap 600, and an angle of about 90° with the support 300. The bottoms surface of the board always forms an angle of about 90° with the hemispheric cap 600, and an angle of about 180°-θ with the support 300, where θ is the smallest angle formed between the support 300 and the floor, usually around 70° and always between 40° and 90°, thereby making the angle with the support 300 obtuse.

The combination of 1) a recess 110 at the edge 102 of the board 100 conforming to the cap 600 for all suitable angular positions, and 2) the absence of acute angles between the board 100 and any adjacent structure render the step 10 particularly safe by preventing any pinching. This is useful if the step 10 is to be installed in a location where children will use it, since children are curious and may introduce their hands in many locations on a mechanism. However, there is no place on the step 10 where small fingers can actually be pinched or trapped during a hinging movement of the board 100. The step 10 is therefore a no-pinch step which is childproof.

Figure 11A:
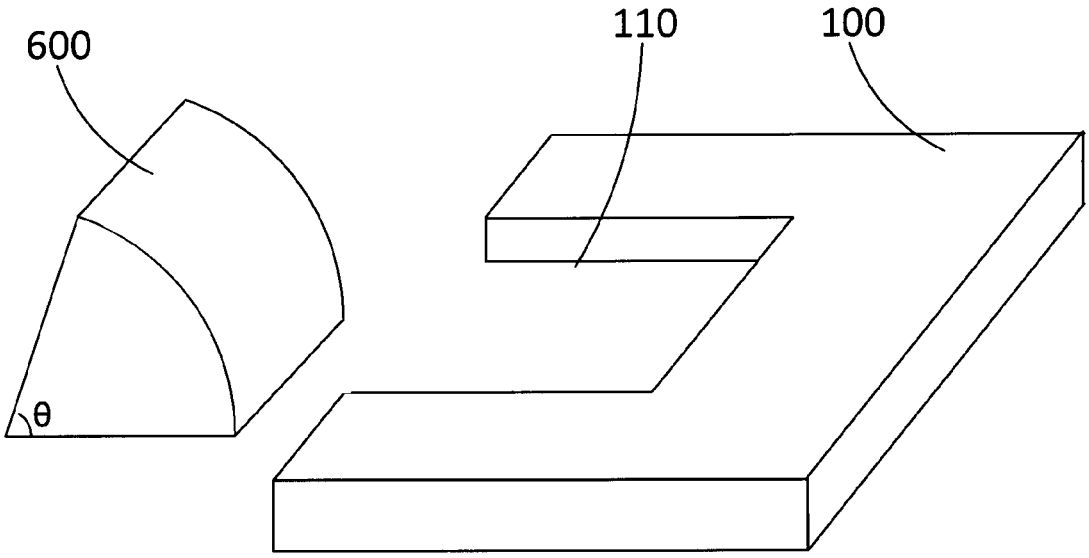
FIG. 11A is a perspective exploded view illustrating a board having a recess conforming to a cap, according to an embodiment.
Figure 11B:
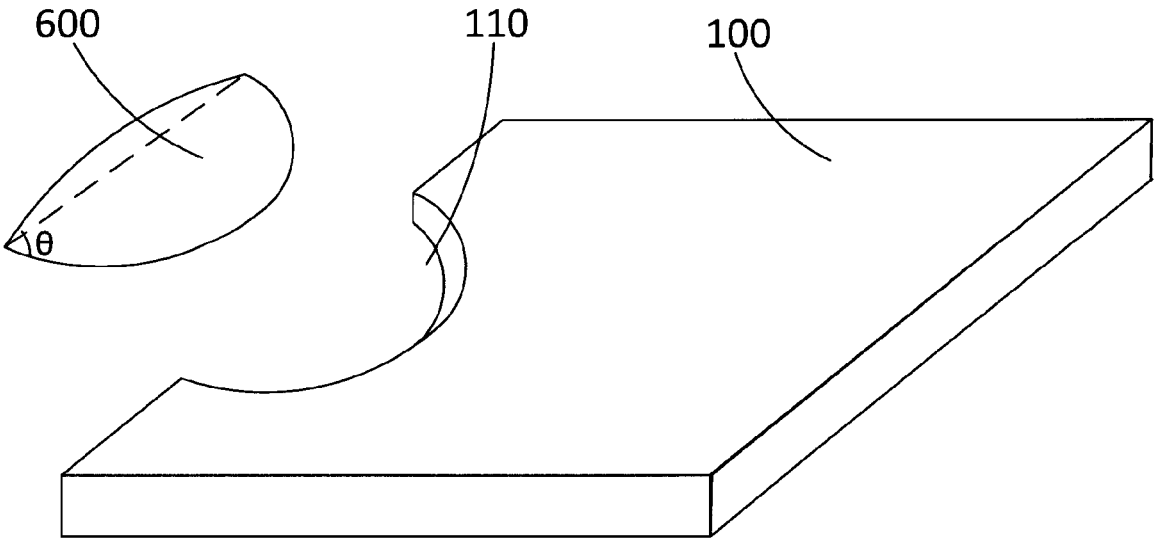
FIG. 11B is a perspective exploded view illustrating a board having a recess conforming to a cap, according to another embodiment.

The cap 600 has been described as hemispheric, a shape being both aesthetic, easy to manufacture and free of sharp edges that could hurt if someone accidentally falls onto the cap 600. However, the cap 600 can be provided in other shapes while providing the same advantage regarding the pinch prevention. If the recess 110 on the edge of the board 100 has a shape S, then the cap 600 can have the shape defined by the revolution of the shape S with respect to the hinge axis 555. For example, as shown in FIG. 11A, if the recess 110 is rectangular, the cap 600 will have the shape defined by that rectangle revolving with respect to the hinge axis 555, which is a hollow wedge of a cylinder. The wedge should span on a range from 0° to the inclination θ to cover the whole angular range that the board 100 can adopt, as shown in FIG. 11A. However, in practice, the cap 600 will have the same curvature beyond the strict range from 0° to the inclination θ, for example, it can span from 0° to 180° to substantially form a half-cylinder and thereby completely cover the top of the foot support 300. In another example, the recess 110 can be defined by an edge being an arc of circle, as shown in FIG. 11B. The cap 600 will have the shape defined by that arc of circle revolving with respect to the hinge axis 555, which is a hollow wedge of a sphere. The wedge should span on a range from 0° to the inclination θ to cover the whole angular range that the board 100 can adopt, as shown in FIG. 11B. However, in practice, the cap 600 will have the same curvature beyond the strict range from 0° to the inclination θ, for example, it can span from 0° to 180° to substantially form a sphere cap and thereby completely cover the top of the foot support 300. If the arc of circle is a half-circle, the cap 600 to which it would conform would be hemispheric, as discussed above. In all cases, regardless the exact shape of the recess 110, the edge of the recess should be at a very marginal and constant distance from the surface of the cap 600 for every angular position of the board 100 from 0° to the inclination θ. This substantially marginal and constant gap should be sub-centimetric, preferably milimetric or below (inexistent if possible), to ensure that no tip of small finger can be pinched in this "gap".

The absence of a gap, or the width of the gap being kept marginal and constant, aids in providing a step where no finger pinching can occur. By removing any acute angle from adjacent surfaces (301, 601) in relative motion (i.e., between the board and either the foot support or the cap), and by covering the hinge mechanism by a cap 600 to make it inaccessible to the user, the step becomes safer to use since no pinching can occur.

As mentioned above, the step 10 comprises only one foot, i.e., only one support 300 on its base/floor fixture 200. This foot eases floor maintenance since there is only one foot to avoid when mopping the floor. The expression "one foot" is also intended to mean one small foot, i.e., a foot that is notably narrower than the board 100, i.e., both the support 300 and base/floor fixture 200 should be kept substantially less large than the board 100 to keep the advantages of having only one foot and leave free the floor surface under the board 100 when it is horizontal. The circular cross-section of the support 300 and, accordingly, of its base/floor fixture 200, further eases the floor maintenance since the circular shape is easy to get around when mopping the floor. It is also easier to clean then other shapes when the step 10 is being manually cleaned.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A step comprising:

a foot;

a hinge system installed on the foot and providing a hinge with respect to the foot;

a board onto which a user can step, the board being fixedly secured to the hinge system for providing a hingeable movement about a hinge axis between a stowed position and a working position;

a cap over the foot and covering the hinge system, wherein the foot and the cap comprise surfaces to which the board is adjacent, namely adjacent surfaces, wherein the board, whether in the stowed position, the working position or in-between, has a top surface that always forms an angle of about 90° with the adjacent surfaces on the cap, and a bottom surface that always forms an angle between 90° and 140°, with the adjacent surfaces of the foot, the step further comprising a spring within the foot, secured to the foot and linked to the hinge system, urging the board toward the stowed position when no weight is applied on the board, wherein the board is fixedly secured to a rotative portion of the hinge system to undergo the hingeable movement within angular limits, wherein the hinge system comprises a static portion fixed with respect to the foot and wherein the rotative portion is hingeable, about the hinge axis, with respect to the static portion, wherein the rotative portion comprises a stopper which abuts on abutting surfaces of the static portion when the board is in the stowed position and when the board is in the working position, the hinge system further comprising a string secured to the spring and to the rotative portion for pulling the rotative portion and the stopper toward a first one of the abutting surfaces.

2. The step of claim 1, wherein the board has the recess located on its periphery and around the hinge system, the recess defined by the shape; and the cap has the outer cap surface of the foot and the cap surfaces substantially defined by the shape forming the recess partially revolving about the hinge axis.

3. The step of claim 2, wherein the shape is an arc of a circle and the outer cap surface is a sphere wedge.

4. The step of claim 2, wherein the shape is substantially semicircular and the outer cap surface is hemispherical.

5. The step of claim 2, wherein the shape is substantially rectangular shape and the outer cap surface is a cylinder wedge.

6. A step comprising:

a hinge system installed on a foot and providing a hinge movement, the hinge system providing two angular limits to the hinge, with respect to the foot;

the foot for supporting the hinge system, wherein the foot is a single foot configured to be secured to a floor;

a board onto which a user can step, the board being fixedly secured to a rotative portion of the hinge system to undergo the hinge movement within the angular limits, the board having a recess located on its periphery and around the hinge system, the recess formed by a shape; and a cap over the foot and above the hinge system, the cap having an outer cap surface substantially defined by the shape of the recess partially revolving about a hinge axis, the outer cap surface thereby being a partial surface of a revolution of the shape of the recess, the cap covering and preventing accessing the hinge system which provides both angular limits, wherein the board is adjacent to a surface of the foot and the outer cap surface, wherein the board is hingeable between a stowed position and a working position, and whether the board is in the stowed position, the working position or in-between, the board has a top surface always forming an angle of about 90° with the outer cap surface, and a bottom surface always forming an angle between 90° and 140°, with the surface of the foot, wherein the single foot is configured to be secured to the floor with an inclination angle (6) with respect to the floor, wherein the board extends in a plane and wherein the plane of the board is substantially horizontal when the board is in the working position, and the plane of the board is substantially inclined at the inclination (6) when the board is in the stowed position, wherein the hinge system further comprising a string secured to a spring and to the rotative portion for pulling the rotative portion and a stopper toward a first one of abutting surfaces of the hinge system.

7. The step of claim 6, wherein the shape is an arc of a circle and the outer cap surface is a sphere wedge.

8. The step of claim 6, wherein the shape is substantially semicircular and the outer cap surface hemispherical.

9. The step of claim 6, wherein the shape is substantially rectangular and the outer cap surface is a cylinder wedge.

10. The step of claim 9, wherein the hinge system comprises a static portion fixed with respect to the foot and wherein the rotative portion is hingeable, about the hinge axis, with respect to the static portion.

11. The step of claim 10, wherein the hinge system comprises a shaft fixedly secured to the board for confining any movement of the board to the hinge movement about the hinge axis.

12. The step of claim 11, wherein the static portion comprises static knuckles holding the shaft therein and by which the shaft can rotate.

13. The step of claim 12, wherein the rotative portion comprises a stopper which provides the angular limits and which abuts on abutting surfaces of the static portion when the board is in the stowed position and when the board is in the working position.

14. The step of claim 13, wherein at least one of the stopper is made of an elastic material to dampen the hinging movement when a respective one of the stowed position and the working position is reached.

15. The step of claim 14, wherein the static portion further comprises a hinge fixture secured to the foot and comprising the abutting surfaces.

16. The step of claim 15, further comprising the spring within the foot, secured to the foot and linked to the hinge system, urging the board toward the stowed position when no weight is applied on the board and the string secured to the spring and to the rotative portion for pulling the rotative portion and the stopper toward the first one of the abutting surfaces.

* * * * *